US005429448A

United States Patent [19]

Ballesteros

[11] Patent Number: 5,429,448

[45] Date of Patent: Jul. 4, 1995

[54] SYSTEM OF SIGNPOSTING, BEACONING, AND SAFETY UPON IMPACT IN BARRIERS FOR PROVISIONAL USE ON HIGHWAYS, ROADS, AND THE LIKE

[76] Inventor: Angel G. Ballesteros, La Espuela No. 3, 29016 Malaga, Spain

[21] Appl. No.: 40,540

[22] Filed: Mar. 31, 1993

[30] Foreign Application Priority Data

Apr. 1, 1992 [ES] Spain ..... 9200693

[51] Int. Cl.[6] ..... E01F 13/00; E01F 15/00

[52] U.S. Cl. ..... 404/6; 116/63 R

[58] Field of Search ..... 404/6, 9, 10, 13, 14; 256/13.1; 116/63 P, 63 R; 40/541, 542, 544, 557, 558

[56] References Cited

U.S. PATENT DOCUMENTS

| | | | |
|---|---|---|---|
| 3,540,699 | 11/1970 | Guzzardella | 256/13.1 |
| 3,807,699 | 4/1974 | France | 404/6 X |
| 4,224,002 | 9/1980 | Hernan et al. | 404/9 |
| 4,681,302 | 7/1987 | Thompson | 404/6 |
| 5,011,325 | 4/1991 | Antonioli | 404/6 |
| 5,046,884 | 9/1991 | Girotti | 404/6 |
| 5,104,254 | 4/1992 | Durand | 404/6 |
| 5,123,773 | 6/1992 | Yodock | 404/6 |
| 5,137,391 | 8/1992 | Ballesteros | 404/6 |
| 5,208,585 | 5/1993 | Sprague | 404/10 X |

FOREIGN PATENT DOCUMENTS

| | | | |
|---|---|---|---|
| 0442249 | 8/1991 | European Pat. Off. | 256/13.1 |
| 460075 | 9/1968 | Switzerland | 256/13.1 |
| 2194268 | 3/1988 | United Kingdom | 404/9 |

*Primary Examiner*—Ramon S. Britts
*Assistant Examiner*—James A. Lisehora
*Attorney, Agent, or Firm*—Gregory W. Carr

[57] ABSTRACT

Provisional road sign barriers and permanent medians are formed based on the correlative, interconnectable arrangement of a number of equal modules, some male and others female, for connecting, which are made of adequate plastic, are hollow and equipped to enclose an electrical supply and corresponding internal lamps that will provide a correct view and real volume of the formed barrier. The modules include, in addition to a metallic reinforcement structure, some sheets that act as elements which absorb the impact of vehicles. The modules will be filled with bags of water, or with sand and/or concrete, as weights, to form a static barrier that carries out the function of signposting and beaconing for works on highways and similar places, and of protecting against the impact of vehicles.

11 Claims, 4 Drawing Sheets

SYSTEM OF SIGNPOSTING, BEACONING, AND SAFETY UPON IMPACT IN BARRIERS FOR PROVISIONAL USE ON HIGHWAYS, ROADS, AND THE LIKE

BACKGROUND OF THE INVENTION

1. Field of Invention

The invention refers to a system of signposting, beaconing, and safety upon impact with barriers for provisional use on highways, roads and the like, whose special, careful design will provide the market and the general public with a series of advantages and benefits lacking in conventional systems intended for similar purposes.

2. Description of the Prior Art

Nocturnal signposting on highways for indicating any type of work-related danger (construction, repair, steps, detours, etc.) are currently based on two systems, one using cones and another using steady or intermittent lamps.

In the first case, the cones usually consist of plastic or rubber, with reflectors at the tops. This system is greatly limited in terms of visibility and protection upon impact, and some countries strictly curtail this type of elements.

In the second case, the lamps are usually installed on metal barricades, cement barriers, water-filled polyethylene barriers or elements, or simply on metal feet that also contain the battery or feeding source. This type of signposting has a series of drawbacks, among which the following can be summarized:

a) They often produce glare for the driver, especially when they are flashing lights.

b) The information that the driver receives from a bright point in the darkness of night is totally inadequate, given that it does not allow him/her to:

1) calculate the distance to the object 2) define the zone nearby 3) define the distance covered or boundaries of the obstacle.

Translating the information received by the driver to the three cartesian axes x, y, and z, the information received by the driver from the road sign lamps relates only to axis y and is nil with respect to axes x and z. The driver only receives the message to "pay attention" and never that of the road signs, which should be the objective of any type of safety device installed on highways.

SUMMARY OF THE INVENTION

The proposed system will offer a very satisfactory solution to all of these problems, since the barrier constituted according to the invention allows the motorist an easy view of the obstacle in the three dimensions x, y, and z, allowing him/her successfully to negotiate it by adjusting speed and direction as a function of the obstacle, which he/she can see perfectly at night. The barrier not only permits correct visualization of the road signs, but also constitutes a protection in case the motorist hits it.

More concretely, the barrier will be constituted by means of the correlative arrangement of a series of equal modules (some male and others female, so that they will be connected to each other side by side), each module presenting a generally prismatic rectangular shape widening at the bottom, according to the shape and function already established in the patent by the same applicant.

Each module consists of a compound of polyester resin reinforced with fiber glass, or another type of plastic material resistant to atmospheric agents, especially ultraviolet rays. The barrier obtained by connecting the modules presents the following peculiarities:

Light weight, so that it can be transported easily by two men without the help of any lifting device.

A resistant inner structure, so that it can contain a metallic structure and a volume of approximately 400 liters of water (200 liters m.l. [expansion unknown; possibly "half loaded"]); the water will be contained in individual bags with an approximate capacity of 80 liters/bag, or it may even be filled with concrete.

Allowing the light emitted from a lamp installed inside the barrier to be seen through the walls of the barrier. The module or barrier will act as a light-diffusing element, to avoid producing glare.

Its design will allow an electrical installation to be lodged inside it; neither the installation itself nor the connection between modules will be visible from the outside.

The device thus constructed will allow signposting to tee shape that are easily visible both during the day (colored barrier) and at night (illuminated barriers) while they act as a buffer in case they are struck by a vehicle. It can perform the latter function in different ways:

a) filled or weighted with water;

b) filled or weighted with water and an internal metallic structure;

c) mixed installation of modules filled with water and an internal structure, alternated with other modules filled with concrete.

According to the above, the module forming the foundation of the signposting and protective barrier acts as a shuttering element or a container of liquids or solids, and the barrier can be used provisionally or definitively. In the latter case the solids that would fill the module would be a mass of concrete, whereas in the former case a barrier perfectly visible at night would be obtained, allowing connectors held together mechanically by screws to be installed inside it, whose elements would be provided to absorb blows or impacts by acting as a buffer for impact.

To make it easier to understand the characteristics off—invention, a detailed description will be given on the basis of a set of diagrams accompanying and forming an integral part off this descriptive note, with a merely directive and nonlimiting character, where the following has been shown:

DETAILED DESCRIPTION OF PREFERRED EMBODIMENT

Figure 1:
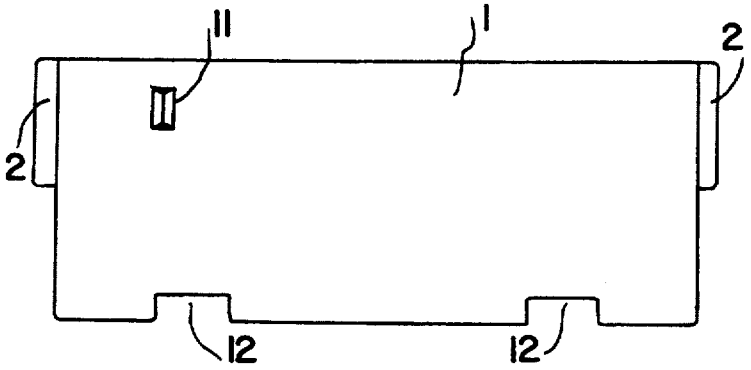
FIGS. 1, 2, and 3 show three views corresponding to a side view, end view, and top view of a male module for the formation of road sign barriers according to the system of the invention.
Figure 2:
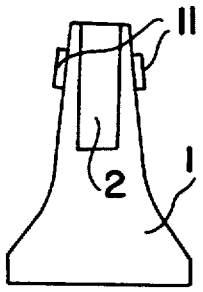
Figure 3:
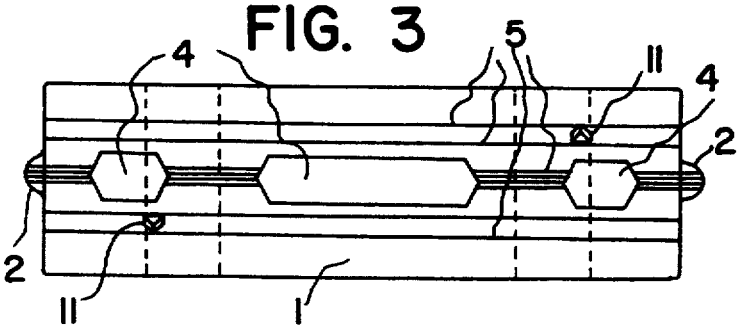
Figure 4:
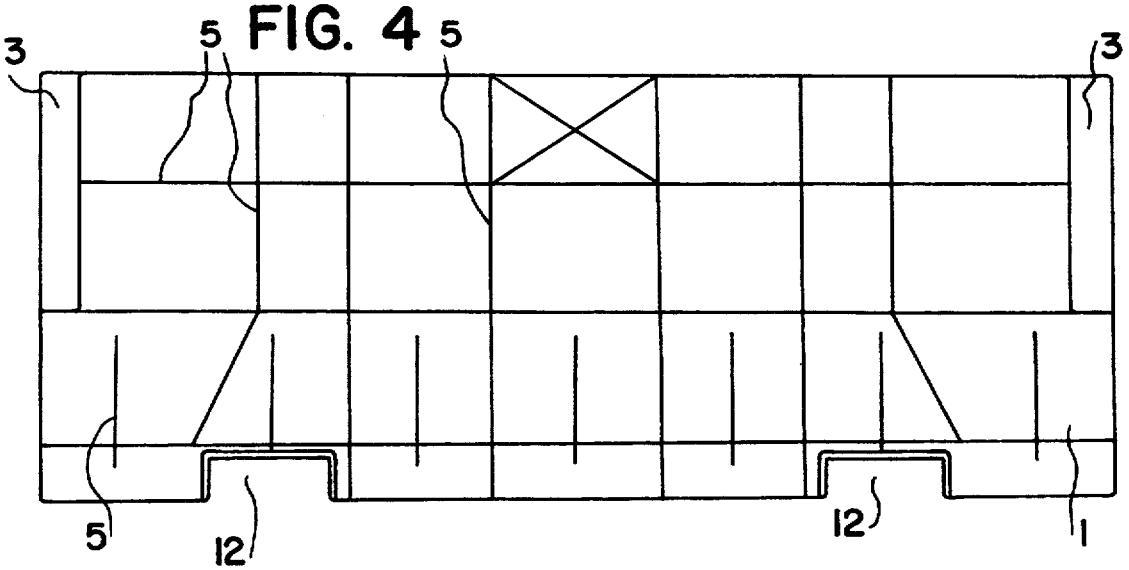
FIGS. 4 and 5 each show sectional views of a module, in this case a female module, with an internal metallic structure for reinforcement.
Figure 6:
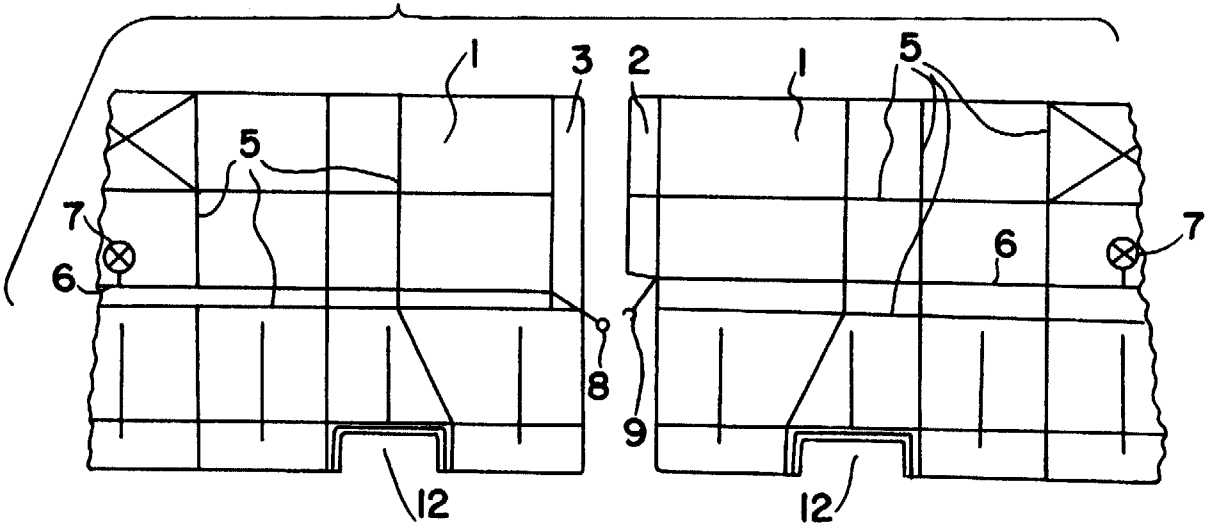
FIG. 6 shows two end parts corresponding to a male and a female module joined together. These modules incorporate an internal electrical lighting installation.
Figure 7:
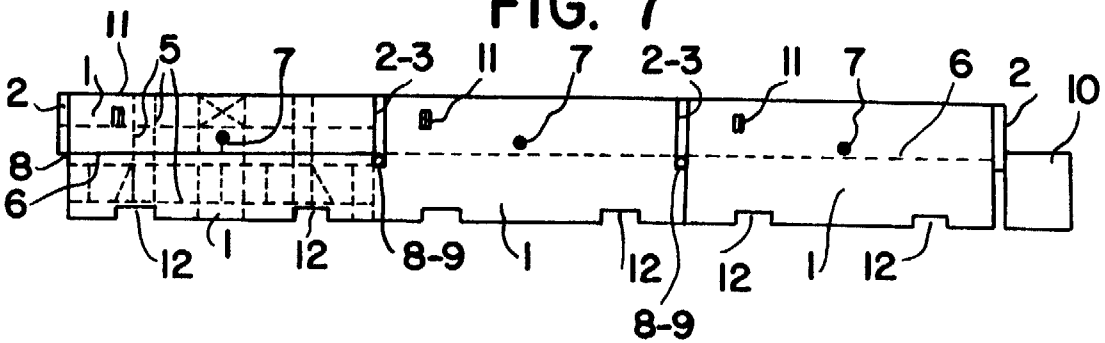
FIG. 7 shows various modules joined together, forming a barrier incorporating an internal means of illumination as represented in the previous figure.
Figure 5:
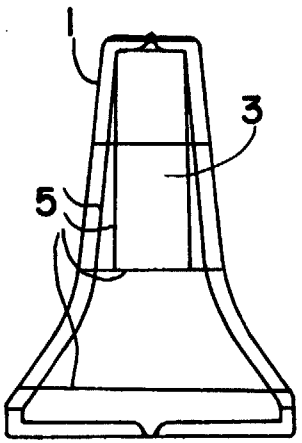
Figure 8:
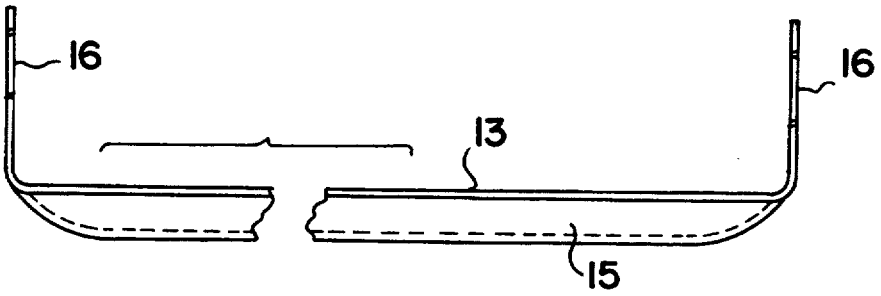
FIGS. 8 and 9 show longitudinal and side views, respectively, of one of the internal metallic elements that the modules can incorporate to absorb impacts.
Figure 9:
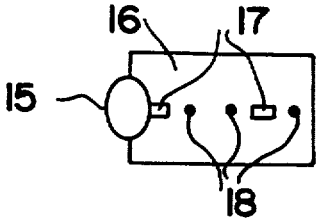
Figure 10:
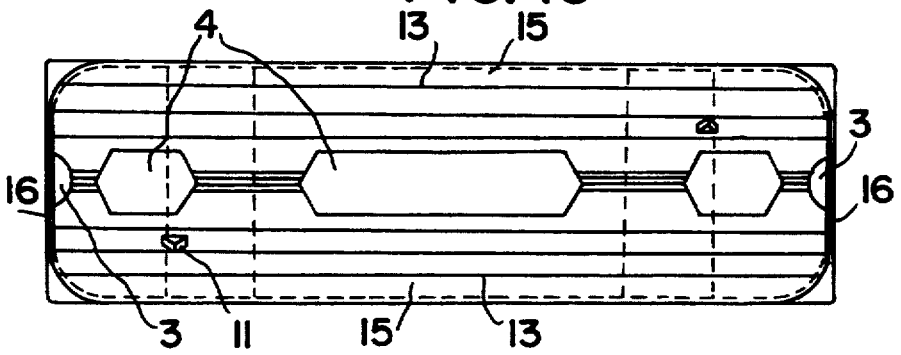
FIGS. 10, 11, and 12 show the practical application of the element represented in the previous figure, and its arrangement and placement can be seen inside the respective module.
Figure 11:
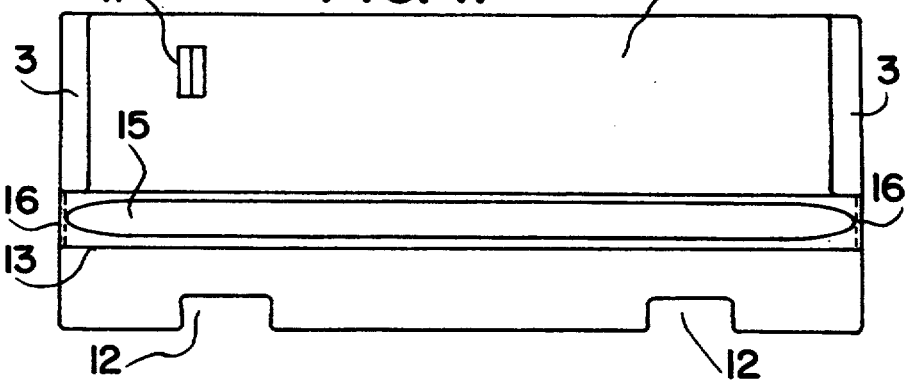
Figure 12:
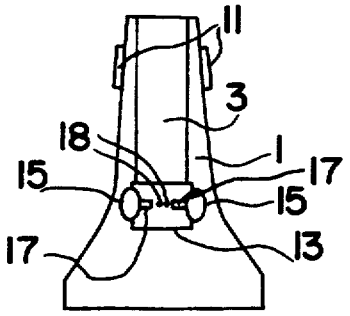
Figure 13:
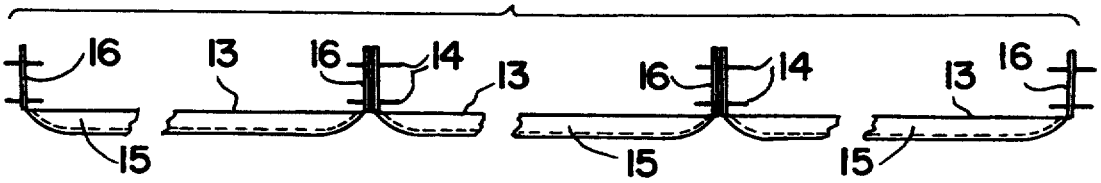
FIGS. 13 and 14 show the way to connect the elements reported in FIGS. 8–12, the connection consisting of a mechanical joint between the modules bearing said elements.
Figure 14:
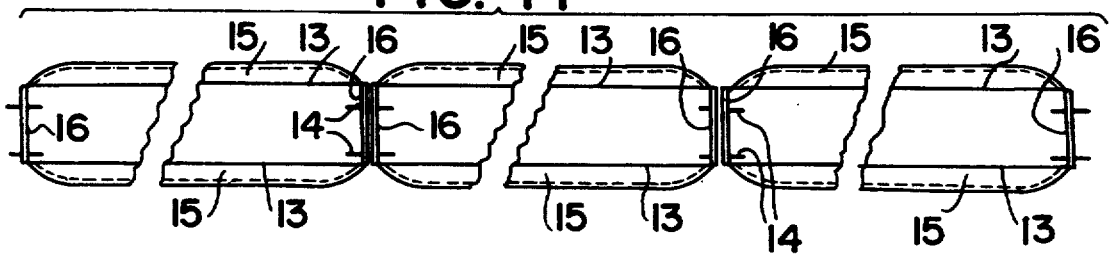

As can be seen in the figures, the barrier, which will take shape as a system of signposting, beaconing, and safety, is obtained by connecting the modules (1) together; in some cases the modules are male, as represented in FIGS. 1, 2, and 3, end in other cases they are female, as represented in FIGS. 4 and 5.

Each module (1) includes at its sides a projection (2) (in the case of male modules) or a complementary inlet (3) (in the case of female modules ), the tops having large openings (4) for the introduction of filling elements, which can be bags of liquid, masses of concrete, sand, etc.

In addition, each module (1) encloses inside itself a metallic reinforcement structure (5), and is able to house an electrical feeding line (6) with outlets for lamps (7) and connections (8) and (9) to ensure electrical continuity in the power supply line when the modules are joined together. Said line (6) can be supplied by means of a battery (10), a generator set, or directly by a main.

On the other hand, the modules (1) will be equipped with supports (11) for catadioptric elements and some lower, crosswise scoops (12) for rain water to pass through.

The setting up of the modules (1) produces road sign barriers; due to the nature of the material and to their having illuminating lamps inside them, the motorist will see a line off illuminated modules forming a volume that marks the shape of the obstacle without producing glare. erefore the driver can see the distance, depth, and height of the obstacle.

Due to the large surface and light weight of the modules (1), since they will normally measure $2\times0.8$ m and weigh 24 kg, they can be easily moved by the wind or even by the slightest shove. To avoid this, the modules will be duly weighted with sand, water, or concrete, although due to the provisional nature, the dead weight most recommendable for its ease of filling and emptying will be water.

The chosen way to fill the modules with water is to use transparent plastic bags 1.1 m high having a capacity of 80 liters/unit. The module can hold $ bags, equivalent to 400 liters. The bags are hung from the top of the module by S-shaped hooks, which makes it easy to fill and empty. In the event that a vehicle softly impacts the module, resulting in partial breakage, filling the module with five individual bags of water keeps all the contained water from emptying out, as would occur if the module were watertight and of a single piece. On the other hand, in case of impact with a small angle of incidence, the vehicle would brake progressively as it hit the bags contained in the module one by one.

If the barrier is formed with modules weighted with water and not joined together, or with a simple joint between the contiguous sides, when a vehicle hits the barrier, it will most logically destroy the barrier and go through it; therefore the set must be given a greater capacity of resistance to impact so that the whole barrier will work together as a unit upon impact, and avoid having the vehicle go through it. This is achieved by equipping the module with a new element, which is described below.

Functionally, if we form the module by placing inside it a metal sheet (13) adjusted to its interior perimeter and at a certain height, so as to allow it to be connected to contiguous and successive modules by means of passing screws (14) & we will obtain a joined, cohesive barrier weighted with water, which upon impact would act as follows:

The vehicle hits the water-filled module and breaks it.

Then it would make contact with the metal sheet lodged in the module, which would try to stop it; for this purpose it would not only rely on its resistant capacity in terms of mass, but through the collateral joints, it would drag the rest of the barrier, so that the vehicle would be stopped by the total mass of the barrier. This mass can be increased if modules weighted with concrete are intercalated at determined spots.

In FIGS. 8–14 the aforementioned metal sheet (13) can be seen, both in isolation and applied to a module or joined to other similar sheets which, obviously, will belong to correlative modules in their barrier-forming arrangement.

Said metal sheet relies on a longitudinal, convex wing (15) and two lateral wings (16) with orifices (17) and (18), the first for the connecting screws (14) to pass through and the second for riveting.

When the barrier must be reinforced in only one direction or on only one side, then the metal sheet is applied only to that side, although as is logical, on the inside; if both sides must be reinforced (two-way traffic), the metal sheet will be arranged on both sides. The first case corresponds to FIG. 13, and the second to FIGS. 11, 12, and 14.

In summary, a provisional road sign barrier according to the object of the invention provides the following:

Easy visibility.
Light weight.
Protection upon impact.
The barrier does not need to be attached to the highway.
Low cost of installation and maintenance (profitability).
Reusability.
Versatility.
Safety.

It should be added that the barrier can be definitively transformed by just filling the modules with the adequate mass of concrete.

What is claimed is:

1. A safety barrier comprising a hollow, substantially enclosed container having a generally prismatic rectangular cross-sectional shape widening on its bottom, generally elongated side walls, a top with an opening for receiving weighing material, and a lamp mounted within the container; wherein the walls of the container are made from a lightweight reinforced plastic material having a predetermined thickness for transmitting diffuse light from the lamp to the exterior of the container, the lamp being adapted for shining on the inside of at least one of the side walls of the container to thereby substantially illuminate the exterior of substantially the entire side wall of the container for improved perception by motorists.

2. The safety barrier of claim 1 wherein the container includes a first end having a first connection surface for coupling to an adjacent barrier to thereby form a continuous barrier.

3. The safety barrier of claim 2 wherein the container includes a first electrical connection coupled to the lamp, the first electrical connection adapted for coupling to an electrical connection on an adjacent barrier.

4. The safety barrier of claim 1 wherein the container includes a steel member extending longitudinally through the container, the steel member having on one end a connector for connecting the member to an adjacent barrier.

5. The safety barrier of claim 1 further comprising a plurality of bags filled with weighing material disposed within the container as ballast.

6. The safety barrier of claim 5 wherein each of the plurality of bags is translucent.

7. The safety barrier of claim 1 further including a plurality of hollow, substantially enclosed containers joined end-to-end, each container including a connector for coupling to an electrical connector on a next adjacent container, each container having a generally prismatic rectangular cross-sectional shape widening on its bottom, generally elongated side walls and a top with openings for receiving weighted material; wherein the walls are made from a lightweight reinforced plastic material having a predetermined thickness for transmitting and diffusing light from a lamp electrically coupled to the electrical connector, each lamp adapted for illuminating the inside of at least one of the walls of the container to cause the exterior of substantially the entire side walls of the container to appear illuminated for improved perception by motorists.

8. The safety barrier of claim 1 further including a plurality of transparent plastic bags filled with water supported inside the container.

9. The safety barrier of claim 1 wherein the container is fabricated from a polyester resin reinforced with fiberglass.

10. A safety barrier comprising:

a hollow, substantially enclosed container of lightweight reenforced plastic material having a generally prismatic rectangular shape widening on its bottom, elongated side walls and a top with openings for receiving weighting material;

a plurality of bags containing weighting materials arranged within the container for weighing the container;

a steel member extending through the container and including a longitudinally extending section adjacent one of the two side walls of the container and wing sections on each end of the section for connecting the member to an adjacent object; and a second steel member having a longitudinally extending section adjacent the other of the two side walls and wing sections on each of the section for connecting the member to an adjacent object.

11. A safety barrier comprising:

a hollow, substantially enclosed container of lightweight reenforced plastic material having a generally prismatic rectangular shape widening on its bottom, elongated side walls and a top with openings for receiving weighting material; and a plurality of bags containing weighting materials arranged within the container for weighing the container;

wherein the side walls of the container are of a thickness for transmitting diffuse light from a lamp mounted within the container to the exterior of the container, the lamp shining on the inside of at least one of the side walls of the container to thereby illuminate the exterior of substantially the entire side wall of container.

* * * * *